US005937523A

United States Patent [19]

Van Keppel et al.

[11] Patent Number: 5,937,523

[45] Date of Patent: Aug. 17, 1999

[54] CIGAR CUTTER

[76] Inventors: Kurt Van Keppel, 5428 Oakview, Shawnee, Kans. 66216; Scott Almsberger, 17320 246th St., Tonganoxie, Kans. 66086

[21] Appl. No.: 09/070,085

[22] Filed: Apr. 30, 1998

[51] Int. Cl.[6] ..... A24C 1/24

[52] U.S. Cl. ..... 30/112; 30/279.2

[58] Field of Search ..... 30/112, 279.2, 30/109; 131/248

[56] References Cited

U.S. PATENT DOCUMENTS 788,425 4/1905 Parris ..... 30/112

1,177,098 3/1916 Gay ..... 30/112

*Primary Examiner*—Douglas D Watts

*Attorney, Agent, or Firm*—Shook, Hardy & Bacon L.L.P.

[57] ABSTRACT

A cigar cutter employing a scissors action is presented by the present invention. Parallel blades move in side-by-side relationship about a pivot point. The blades are provided with handles to permit gripping in the palm of the hand of a user. Since the blades are mounted for movement about a pivot point, a mechanical advantage is obtained which increases the force applied over simple linear movement.

6 Claims, 2 Drawing Sheets

CIGAR CUTTER

BACKGROUND OF THE INVENTION

1. Field of the Invention

The present invention relates to a novel hand operated mechanism for cutting cigars.

2. Description of the Prior Art

Hand held devices are known for cutting the tip from cigars. Typically, simple devices for cigar cutting consist of one or two blades slidably mounted in a case, which blade(s) crush down on the cigar to separate the tip. The crushing action tends to tear unevenly, rather than shear evenly the tip of the cigar. Such mechanisms have no mechanical force advantage, but depend upon the strength of the operator to force the blade(s) against the cigar tip. Sliding mechanisms are inherently subject to alignment concerns because of the necessary contact surface of the sliding mechanisms, causing uneven closing of blade(s). Further, hand operation of the sliding action may seem unnatural and inconvenient to the operator.

Other cigar-cutting devices use complex cam mechanisms to cause shearing of the cigar tip, avoiding the crushing of the tip. However, these mechanisms tend to be more complex and costly and, due to their complexity, may have excessive weight and size for hand use.

SUMMARY OF THE INVENTION

The present invention addresses the problems discussed above. The present invention is a unique cigar cutter suitable for hand-held operation. It comprises hinged blades in a compact case, such blades operating in a scissors-like fashion to cleanly shear the tip of a cigar and fashioned to provide a mechanical advantage to the operator.

It is therefore an object of the present invention to provide a cigar cutter which can be gripped in the palm of the hand so as to offer a more comfortable and more powerful cutting action than previous cigar cutters.

Another object of the invention is to provide a cigar cutter wherein the blades are mounted about a pivot point so as to provide a mechanical advantage which increases the cutting force of the blades over what can be achieved with linear movement.

Another objective of this invention is to provide a cigar cutter wherein the cutting action is achieved by dual blade surfaces which move in a parallel scissors action through an arc so as to achieve a superior cutting action.

It is also an important aim of this invention to provide a cigar cutter which meets the objectives set forth above and which is self contained in a protective carrying case.

Still another one of the objects of my invention is to provide a cigar cutter which employs a scissors action and which automatically opens to receive a cigar when a safety lock is released.

These and other objects of the invention will be made clear or become apparent from the following description and claims when read in light of the accompanying drawing.

DETAILED DESCRIPTION OF THE INVENTION

Figure 1:
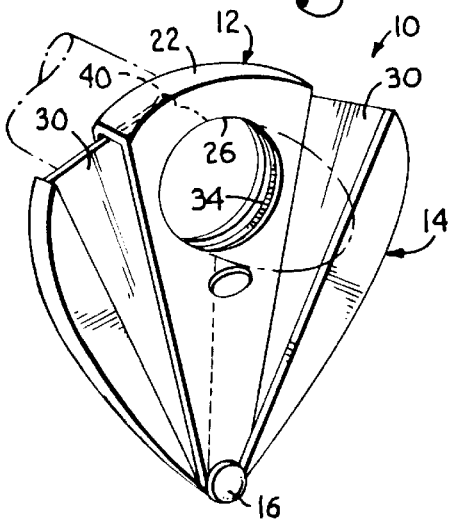
FIG. 1 is a perspective view of the cigar cutter of the present invention.

Referring initially to FIG. 1, the cigar cutter of the present invention is designated generally by the numeral 10. Cigar cutter 10 comprises a wedge-shaped body portion 12 and first and second movable arms 14. Arms 14 are joined to body 12 by a pin 16.

Figure 3:
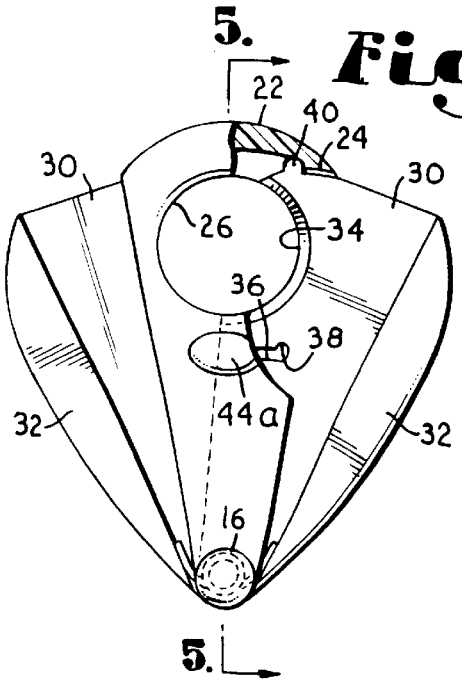
FIG. 3 is a front elevational view showing the cigar cutter in the open position with portions cut-away for clarity.
Figure 4:
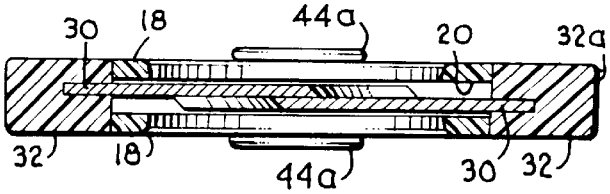
FIG. 4 is a horizontal cross-sectional view taken along line 4—4 of FIG. 2.
Figure 5:
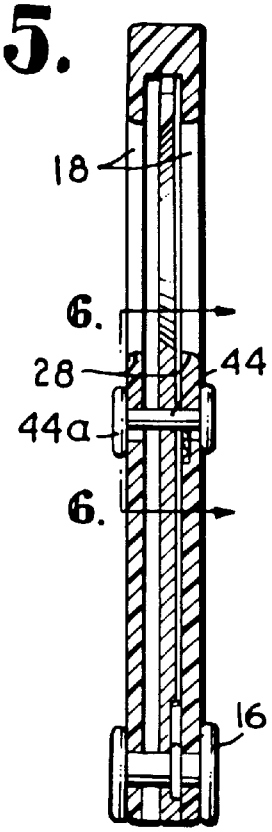
FIG. 5 is a vertical cross-sectional view taken along line 5—5 of FIG. 3.

Referring to FIGS. 1, 4 and 5, body 12 comprises two wedge-shaped sides 18 which are spaced apart to present an elongated slotted opening 20. Sides 18 are integral with an arcuate end wall 22. End wall 22 is configured to present two internal shoulders 24, one at each end, one of same being visible in FIG. 3. Each side 18 has a circular opening 26 which is in alignment with the opening in the opposite wall. Each side 18 also includes a vertically elongated slot 28.

Referring now to FIG. 3, each of the moveable arms 14 is substantially identical and will be described in detail. Arm 14 comprises a blade 30 and a handle 32 which extends along the exposed side of the blade. Blade 30 has an arcuate cutting edge 34 extending over a distance of approximately 170°. Blade 30 also has a horizontally extending slot 36 which terminates in a vertical extension 38 at one end. An upwardly projecting ear 40 at the top of blade 30 is positioned to engage shoulder 24.

Figure 7:
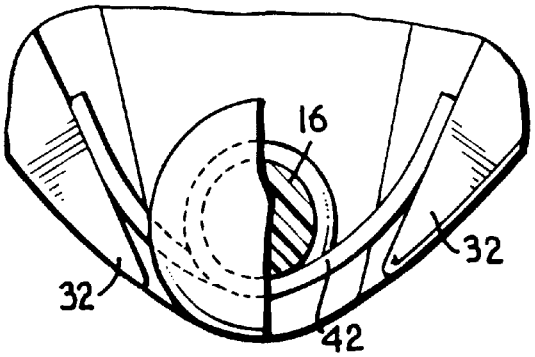
FIG. 7 is an enlarged detail of a spring biasing means.

As best seen in FIG. 4, blade handle 32 has a width corresponding to the overall thickness of body 12 and those portions of the handle which project on either side of blade 30 abut the edges of sides 18. Blade handle 32 has an arcuate outer surface 32*a*, the angle of curvature of which corresponds to the angle of curvature of end wall 22, so that the blade handles and housing cooperate to present a smooth continuous surface in the closed position shown in FIG. 2. As best seen in FIG. 7, a hairpin torsion spring 42 extends around pivot pin 16 and the free arms of the spring engage the two blade handles 32. It is to be noted that while arms 14 are substantially identical in construction, the blade 30 of the right hand arm, when viewing FIGS. 1 and 4, is offset relative to the center of blade handle 32 in one direction and the blade 30 of the opposite arm is offset relative to the center of its blade handle in the opposite direction. This allows the two blades to be mounted within slotted opening 20 in side-by-side relationship as illustrated in FIG. 4.

Figure 6:
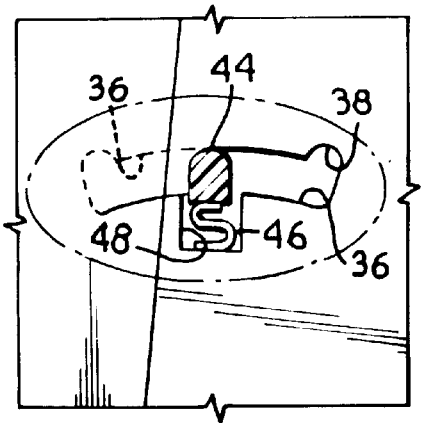
FIG. 6 is an enlarged vertical cross-sectional view taken along line 6—6 of FIG. 5.

A locking pin 44 (FIGS. 5 and 6) extends through slots 28 in sides 18 and also through slots 36 in blades 30. Pin 44 is biased in an upward direction by spring 46 which is received in a channel 48 in one of sides 18. Locking pin 44 terminates in an enlarged head 44*a* at each end.

Figure 2:
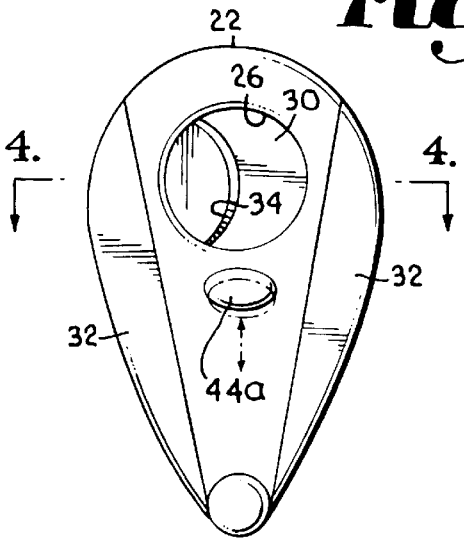
FIG. 2 is a front elevational view showing the cigar cutter in the closed position.

Cigar cutter 10 is normally disposed in the closed position shown in FIG. 2 with blade handles 32 abutting sides 18 and the entire cutter presenting a generally teardrop shape with a continuously curved outer surface configured to generally conform to the palm of a user. Arms 14 are retained in the closed position by locking pin 44 which is spring biased into the vertical extension 38 of slot 36.

When it is desired to use cutter 10 to cut the tip of a cigar, either head 44*a* of locking pin 44 is moved downwardly against the action of spring 46 so as to clear the vertical extension 38 and allow blades 30 to move relative to the pin by virtue of slots 36. When this occurs, torsion spring 42, which is continually biasing arms 14 away from sides 18, will move blades 30 into the open position illustrated in FIGS. 1 and 3. Ears 40 on blades 30 engage shoulders 24 as to limit the outward extent of movement of arms 14 and retain the cutting edge of the blades within body 12. A cigar to be cut is inserted into opening 26 as illustrated in FIG. 1. Handles 32 are held in the palm of a user and are grasped and forced closed so as to achieve the cutting action as the blades pivot about pin 16.

The scissors action and configuration of cutter 10 is an improvement over previous cigar cutters which have used a guillotine action for several reasons. The scissors action allows the cutter to be held in the palm of the hand where greater force can be applied than with a guillotine cutter which is held between two fingers. Furthermore, the construction of cutter 10 with blades 30 acting about pivot pin 16 provides a simple mechanical advantage which is not possible with guillotine type cutters of the prior art. The scissors action of two blades 30 moving in parallel with two cutting edges acting from opposite directions also provides a more positive cutting action than prior art cigar cutters.

It will be appreciated that various types of materials may be employed for blades 30. The particular material will determine the sharpness of the blade and the blade life. In most instances, it preferable to use molded plastic for body 12 and arms 14, although other materials may also be employed. While stainless steel is the preferred material of blades 30, a ceramic cutting edge could also be provided.

From the foregoing, it will be seen that this invention is one well adapted to attain all the ends and objects hereinabove set forth together with other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative and not in a limiting sense.

What is claimed is:

1. A cigar cutter comprising:

a frame with a slot and a hole therethrough, said frame having two sides which are parallel to each other, said frame being teardrop shaped, which slot has a rectangular cross section, and which hole is perpendicular to the slot and is sized to accommodate a cigar tip; and two blades, each blade with a hinge end and a cutter end, said cutter end having two edges, the first of which said edges is sharp and the second of which is dull, said blades hingeably coupled with each other and said frame and operably mounted so that said blades slide through the slot in said frame and effectuate movement of first edges of said cutter ends of said blades across each other scissors-like, said blades crossing at the hole in said frame.

2. A cigar cutter as claimed in claim 1 further comprising:

a means for spring biasing said cutter end of said blades apart; and a means for retaining said cutter end of said blades together and operating to release said blades to allow movement.

3. A cigar cutter as claimed in claim 1 wherein said sharp edge is ceramic.

4. A cigar cutter as claimed in claim 1 wherein said sharp edge is metal.

5. A cigar cutter as claimed in claim 1 wherein said sharp edge is crescent-shaped.

6. A cigar cutter as claimed in claim 2 wherein said sharp edge is serrated.

* * * * *